United States Patent [19]

Tsubata et al.

[11] Patent Number: 4,823,446

[45] Date of Patent: Apr. 25, 1989

[54] FLUID-TIGHT SLIDE FASTENER STRINGER

[75] Inventors: Noritaka Tsubata, Uozu; Koichi Tanikawa, Toyama; Kozo Watanabe, Kurobe, all of Japan

[73] Assignee: Yoshida Kogyo K. K., Tokyo, Japan

[21] Appl. No.: 165,423

[22] Filed: Mar. 1, 1988

2,775,012 12/1956 Mulka.

[30] Foreign Application Priority Data

Mar. 14, 1986 [JP] Japan ..... 61-37979[U]
Mar. 18, 1986 [JP] Japan ..... 61-39607[U]

[51] Int. Cl.[4] ..... A44B 19/32

[52] U.S. Cl. ..... 24/389; 24/393; 24/414

[58] Field of Search ..... 24/389, 392, 393, 395, 24/414

[56] References Cited

U.S. PATENT DOCUMENTS 2,075,762 3/1937 Kelley ..... 24/414

Related U.S. Application Data

[63] Continuation of Ser. No. 24,529, Mar. 11, 1987.

2,791,017 5/1957 Mulka ..... 24/389
3,579,748 5/1971 Chery ..... 24/395
3,847,188 11/1974 Auer et al. ..... 24/393
4,216,805 8/1980 Akashi ..... 24/392
4,247,968 2/1981 Moertel ..... 24/395
4,275,467 6/1981 Doelter ..... 24/389
4,312,102 1/1982 Fukuroi ..... 24/389
4,348,789 9/1982 Brown ..... 24/414
4,378,683 4/1983 Matsuda et al. ..... 24/393
4,488,338 12/1984 Takahashi ..... 24/389
4,513,482 4/1985 Fukuroi ..... 24/389

FOREIGN PATENT DOCUMENTS 0796468 10/1968 Canada ..... 24/389
30130 1/1955 Japan .
57-128106 8/1982 Japan .
58-181211 12/1983 Japan .
59-93208 6/1984 Japan .
59-93209 6/1984 Japan .
59-51805 12/1984 Japan .
2072229 9/1981 United Kingdom.
2084469 5/1982 United Kingdom.
2104145 3/1983 United Kingdom.
2120722 12/1983 United Kingdom.
2158506 11/1985 United Kingdom.

*Primary Examiner*—Victor N. Sakran
*Attorney, Agent, or Firm*—Hill, Van Santen, Steadman & Simpson

[57] ABSTRACT

A fluid-tight slide fastener stringer has a fluid-tight tape including a longitudinally non-stretchable and transversely stretchable woven or knit fabric wholly covered with a layer of elastic rubber or synthetic resin. The tape has non-stretchable warp inlaid threads and stretchable weft inlaid threads. The laterally stretchable tape serves as a shock absorber for reducing the intensity of external lateral pulling forces exerted on the tape.

1 Claim, 2 Drawing Sheets

FLUID-TIGHT SLIDE FASTENER STRINGER CROSS REFERENCE TO RELATED APPLICATIONS

This application is a continuation of U.S. patent application Ser. No. 24,529, filed Mar. 11, 1987.

BACKGROUND OF THE INVENTION

1. Field of the invention

The present invention relates generally to slide fasteners, and more particularly to a fluid-tight (airtight and watertight) slide fastener suitable for wet suits, life preservers, etc.

2. Description of the Prior Art

U.S. Pat. No. 2,791,017, issued May 7, 1957 to F. Mulka, and U.S. Pat. No. 4,348,789, issued Sept. 14, 1982 to Brown, show a fluid-tight slide fastener of the type in which an inner longitudinal edge portion of each of opposed fluid-tight tapes is folded so as to extend around base portions of successive I-shaped coupling elements and in which successive C-shaped clamping strips surround, in clenched form, the folded edge portion over the base portion of the respective coupling element. The fluid-tight tape of the U.S. patent to Brown includes a textile fabric wholly covered with a fluid-tight layer of elastic rubber; the textile fabric serves to restrict the stretchability of the elastic rubber layer. The prior fluid-tight tape has the following problems:

If the fluid-tight tape is longitudinally stretchable, it is difficult to keep the coupling elements from staggering element-to-element distances or pitches during the coupling and uncoupling of the opposed stringers, thus impairing the function of the slide fastener.

If the fluid-tight tape is transversely non-stretchable, it cannot be deformed so as to follow the movement of the coupling elements during the coupling and uncoupling of the opposed stringers, thus causing not only non-smooth movement of a slider, but also inadequate fluid-tightness between the opposed stringers.

SUMMARY OF THE INVENTION

It is therefore an object of the present invention to provide a fluid-tight stringer for slide fasteners suitable for wet suits, life preservers and the like.

Another object of the invention is to provide a fluid-tight slide fastener stringer in which a series of coupling elements on a fluid-tight tape can be kept from staggering element-to-element pitches during the opening and closing operation of the slide fastener and in which the tape is elastically deformable so as to follow the movement of the coupling elements during the opening and closing operation of the slide fastener, thus causing not only smooth movement of a slider, but also an improved fluid-tightness between the opposed stringers.

According to the present invention, a fluid-tight slide fastener stringer has a fluid-tight tape including a longitudinally non-stretchable and transversely stretchable knit or woven fabric wholly covered with a layer of elastic rubber or synthetic resin. The tape has non-stretchable warp inlaid threads and stretchable weft inlaid threads.

Many other advantages, features and additional objects of the present invention will become manifest to those versed in the art upon making reference to the detailed description and the accompanying drawings in which certain preferred structural embodiments incorporating the principles of the present invention are shown by way of illustrative example.

DETAILED DESCRIPTION

Figure 1:
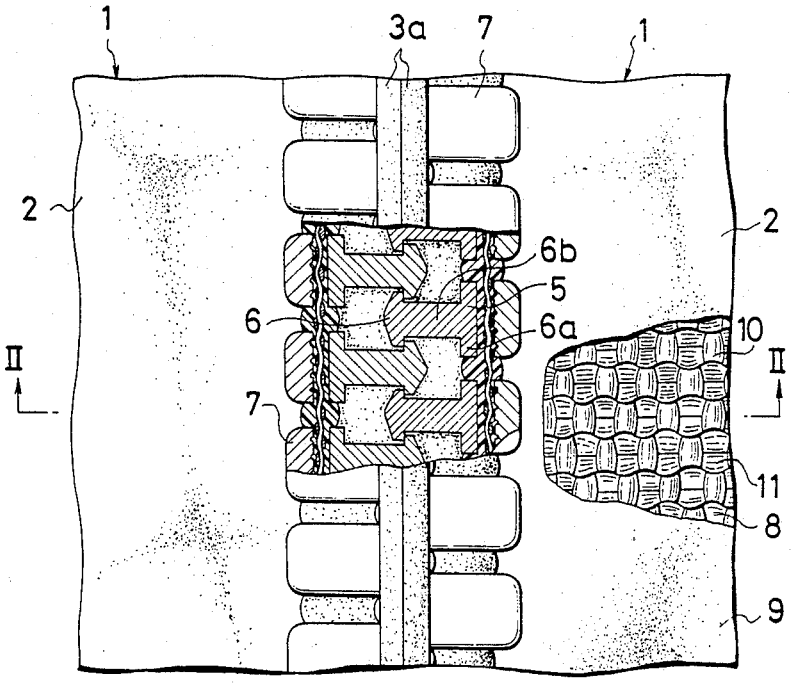
FIG. 1 is a fragmentary plan view, partially in cross section, of a pair of interengaged fluid-tight slide fastener stringers each embodying the present invention.

FIG. 1 shows a pair of opposed fluid-tight slide fastener stringers 1, 1 each having a fluid-tight tape 2.

As better shown in FIG. 2, the tape 2 has an inner longitudinal margin folded through its entire length so as to provide a folded portion 4 and two contact portions (hereinafter referred to as "first and second contact portions) *3a*, *3b* disposed one on each side of the portion 4 and contiguous thereto. The first and second contact portions *3a*, *3b* are laterally (vertically in FIG. 2) spaced from each other.

A series of discrete coupling elements 5 is mounted on and along the folded portion 4 of each tape 2. Each of the coupling elements 5 has a generally horizontal I-shaped cross section having a base portion *6a*, a leg portion *6b*, and a head portion 6. The folded portion 4 of the tape 2 extends around the base portion *6a* of each coupling element 5. A series of generally C-shaped clamping strips 7 is also mounted in clenched form on and along the folded edge portion 3 of the tape 2, each clamping strip 7 surrounding the folded edge portion 4 of the tape 2 over the base portion *6a* of a respective one of the coupling elements 5. The series of coupling elements 5 of one stringer 1 is engageable with the series of coupling elements 5 of the other stringer 1 by pulling a slider S which is mounted on the opposed stringers 1, 1 for movement along the two series of coupling elements 5 to open and close the slide fastener. When the opposed series of coupling elements 5, 5 are coupled together, the first and second contact portions *3a*, *3b* of one stringer 1 are pressed against the first and second contact portions *3a*, *3b*, respectively, of the other stringer 1 to effect a fluid-tightness between the opposed stringers 1, 1.

The tape 2 includes a core or ground fabric 8 of textile material, an elastic and fluid-tight layer 9 of rubber or synthetic resin wholly covering both front and rear surfaces of the ground fabric 8. The ground fabric 8 is woven of substantially non-stretchable warp threads 10 and stretchable weft threads 11. The warp threads 10 may comprise polyester fiber yarns, while the weft threads 11 may comprise nylon or polyurethane fiber yarns.

To restrict the extent to which the polyurethan fiber yarn is stretchable, a spun yarn may be spirally wound on the polyurethane fiber yarn, thus providing a covered yarn.

In the case where the fluid-tight layer 9 is made of rubber, it is preferable to use nylon fiber yarns for the weft threads 11, since generally rubber has a good adhesive property to nylon.

Although the ground fabric 8 of FIG. 1 is densely woven, it may be coarsely woven so that the rubber or synthetic resin material (of the fluid-tight layer 9) attached to the opposite surfaces of the ground fabric 8 permeates through the interstices of the woven structure to blend with the material on each other fabric surface.

Figure 2:
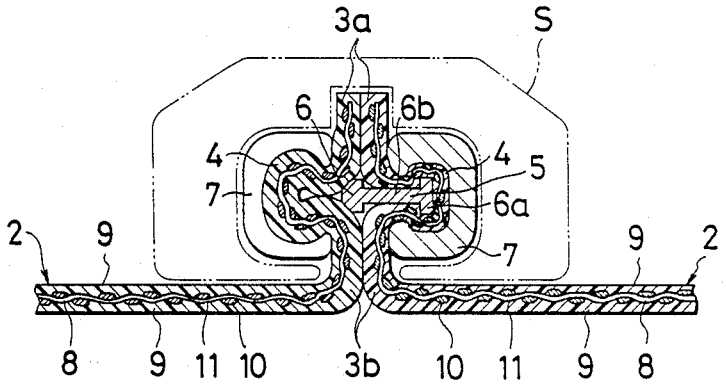
FIG. 2 is a transverse cross-sectional view taken along line II—II of FIG. 1.

As shown in FIG. 2, it is preferable that the fluid-tight layer 9 at the rear or lower side of the ground fabric 8 has a thickness greater than the thickness of the layer 9 at the front or upper side. With this arrangement, the opposed contact portions 3*a*, 3*b* and 3*a*, 3*b* of the two tapes 2, 2 are contactable with each other at their greater-thickness layers which are more deformable, thus causing an improved fluid-tightness.

Alernatively, the fluid-tight layer 9 may comprise polyvinyl chloride, polyurethane or sponge rubber.

Figure 3:
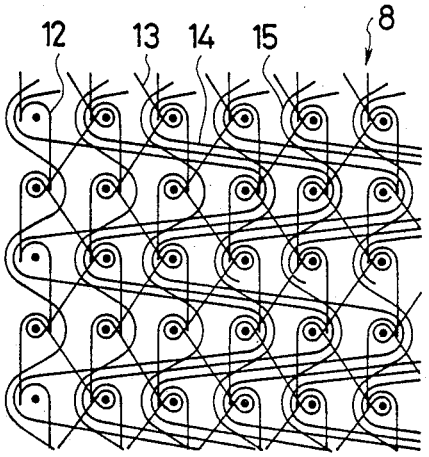
FIG. 3 is a point diagram illustrating a warp-knit structure of a ground fabric of a stringer tape according to a modified embodiment of the invention.
Figure 4:
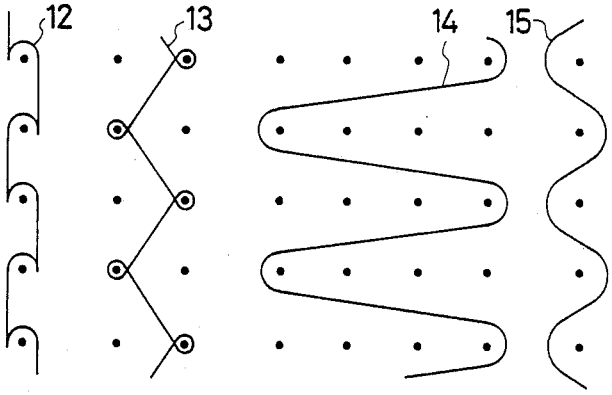
FIG. 4 is a point diagram illustrating the knitting patterns of various threads of FIG. 3.

Further, the ground fabric 8 may be a warp-knit fabric having a plurality of longitudinal wales, as shown in FIG. 3. The warp-knit fabric 8, as shown in FIG. 4, is formed of threads 12 of chain stitch each extending along the respective wale, threads 13 of tricot stitch each extending across two wales, weft inlaid threads 14 each extending across four wales, and warp inlaid threads 15 each extending along the respective wale. The weft inlaid threads 14 comprise stretchable yarns, while the warp inlaid threads 15 comprise non-stretchable yarns.

In the warp-knit fabric 8 of FIG. 3, the only threads disposed in each interwale groove are the threads 13 of tricot stitch and the weft inlaid threads 14 to provide a coarse network so that the rubber or synthetic material (of the fluid-tight layer 9) attached to the opposite surfaces of the fabric 8 permeates through the interstices of the knit structure to blend with the material on each other fabric surface.

The fluid-tight slide fastener stringer 1 thus constructed is advantageous in that since the fluid-tight tape 2 is longitudinally non-stretchable, a series of coupling elements 5 can be mounted on the inner tape margin accurately at the predetermined pitch in the production of the slide fastener. In use, the coupling elements 5 on the tape 2 remain at that pitch.

Another advantage of the stringer 1 is that since the tape 2 is transversely stretchable, smooth coupling and uncoupling of the opposed strengers 1, 1 can be achieved.

Further, the transversely stretchable tape 2 serves as a shock absorber for reducing the intensity of external lateral forces exerted on the stringers 1, 1 so that both the interengagement of the opposed coupling elements 1 and the fluid-tight contact between the opposed contact tape portions 3*a*, 3*b* and 3*a*, 3*b* are prevented from being impaired.

Although various minor modifications may be suggested by those versed in the art, it should be understood that we wish to embody within the scope of the patent granted hereon, all such embodiments as reasonably and properly come within the scope of our contribution to the art.

What is claimed is:

1. A fluid-tight slide fastener stringer comprising:

(a) a fluid-tight tape including (1) a ground fabric having non-stretchable warp inlaid threads and stretchable weft inlaid threads, and (2) a fluid-tight layer of elastic material covering opposite surfaces of said ground fabric;

(b) a series of discrete coupling elements mounted on said tape along an inner longitudinal edge portion thereof, each of said coupling elements having a generally I shape having a base portion, a leg portion and a head portion;

(c) said inner longitudinal edge portion of said tape having a longitudinally extending fold so as to extend around said base portions of said coupling elements;

(d) a series of generally C-shaped clamping strips each surrounding in clenched form said fold portion of said tape over said base portion of a respective one of said coupling element;

(e) said fluid-tight layer at a rear side of said ground fabric having a thickness greater than the thickness of said layer at a front side of said ground fabric to which side said clamping strips are clinched; and (f) the fluid-tight layer at the rear of the ground fabric having in its free state a thickness greater than the thickness of said fluid-tight layer.

* * * * *